United States Patent [19]

Sferragatta

[11] 4,395,056

[45] Jul. 26, 1983

[54] NOTE BOOKLET, PROVIDED WITH A FOLDABLE COVER, EFFECTIVE TO ACT AS A SHEET AND PEN HOLDER

[75] Inventor: Enrico Sferragatta, Monza, Italy

[73] Assignee: Mille Note System S.r.l., Monza, Italy

[21] Appl. No.: 282,519

[22] Filed: Jul. 13, 1981

[30] Foreign Application Priority Data

Oct. 16, 1980 [IT] Italy ..... 23113/80[U]

[51] Int. Cl.[3] ..... B42D 3/00; B65D 5/52

[52] U.S. Cl. ..... 281/31; 40/120; 206/45.21

[58] Field of Search ..... 281/29, 31, 33; 40/120, 40/539; 206/45.2, 45.21, 45.22, 45.24, 45.28

[56] References Cited

U.S. PATENT DOCUMENTS

| | | | |
|---|---|---|---|
| 1,334,932 | 3/1920 | Gray | 206/45.21 |
| 1,340,744 | 5/1920 | Van Iderstine | 206/45.21 |
| 2,490,356 | 12/1949 | Hummel | 281/33 X |
| 3,220,752 | 11/1965 | Sloves | 281/33 |
| 3,708,184 | 1/1973 | Slanhoff | 281/33 |
| 4,143,847 | 3/1979 | Cross | 40/120 X |
| 4,240,761 | 12/1980 | Jacobsen | 281/33 X |

*Primary Examiner*—Gil Weidenfeld
*Assistant Examiner*—John S. Brown
*Attorney, Agent, or Firm*—Bucknam and Archer

[57] ABSTRACT

A note booklet having a pad of note sheets secured to the back of a cover having multiple fold lines and divided thereby into multiple sections, such that in use, the cover member is foldable into a configuration whereby a first plane section extends backwards from the pad of note sheets to position a second plane section and a flap that defines a pocket with the second plane section behind the note sheets with the pocket exposed, and with a third plane section extending in underlying relation to the bottom of the note sheets pad.

4 Claims, 6 Drawing Figures

FIG 1
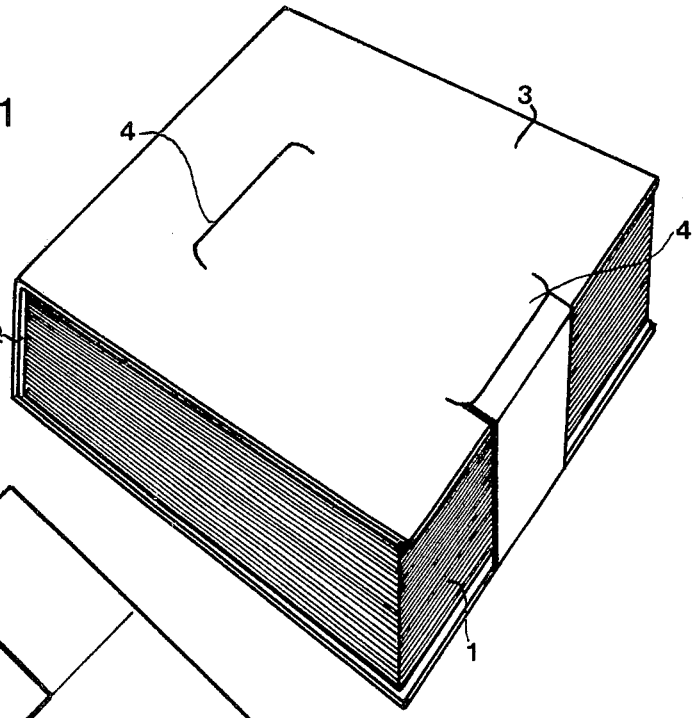
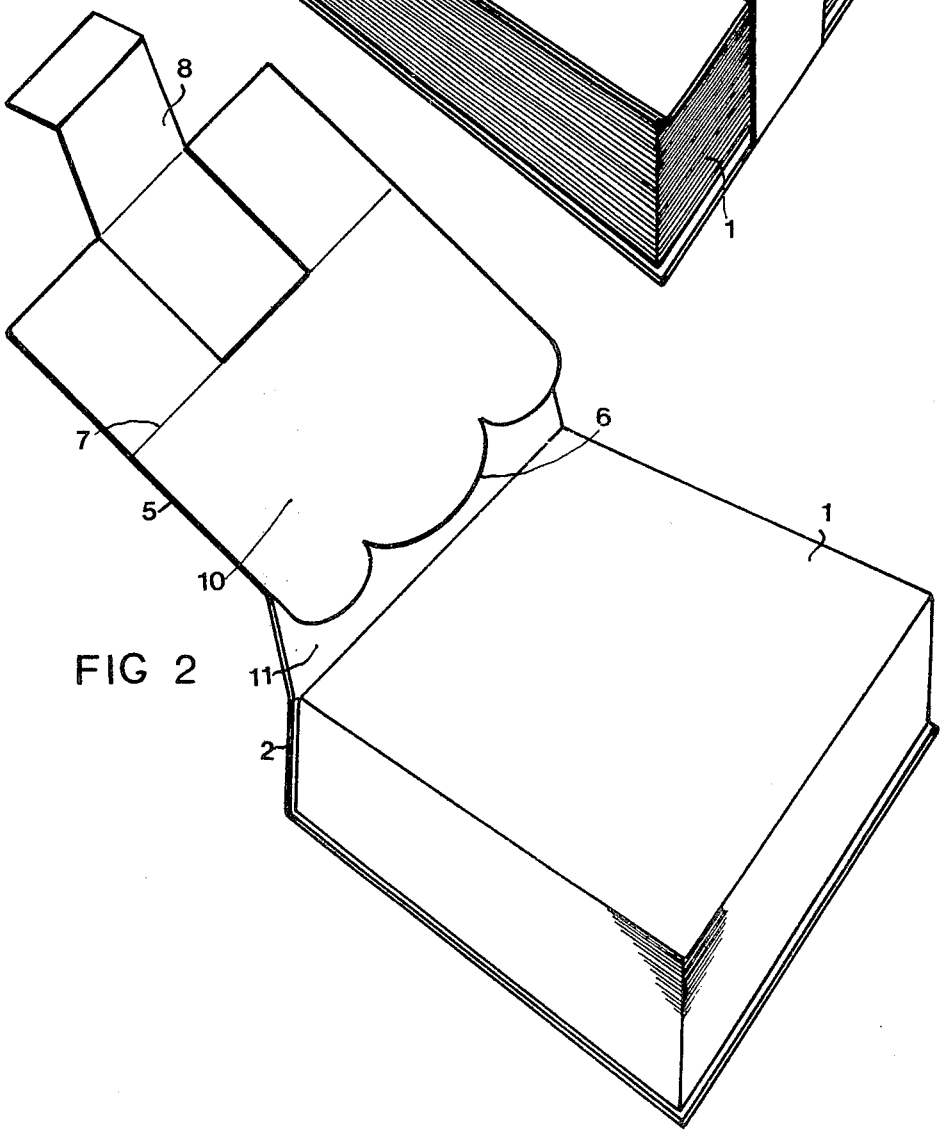
FIG 2

1'
13
11
12
6
10A
10
B
A
5
7A
7
C
2
1

9
3
4
5
2
1

11
1
2
14
13'
8
3
4
5
7
4
2
1

NOTE BOOKLET, PROVIDED WITH A FOLDABLE COVER, EFFECTIVE TO ACT AS A SHEET AND PEN HOLDER

BACKGROUND OF THE INVENTION

The present invention relates to a note-booklet, provided with a foldable cover member, effective to act as a sheet and pen holder.

As it is known, it is conventional for determined makers, banks, professional offices and the like to give their clients, under particular circumstances, advertising articles.

Among these articles there are to be mentioned, owing to their reduced cost, the so-called note-booklets which substantially comprise a plurality of stacked small sheets as associated with a generic binding arrangement and enclosed by a cardboard cover member.

It is also known that the purpose of the aforesaid advertising articles is that of acting as a supporting member for an advertising message.

On the other hand the known note booklets, as they are presently made, provides little space for this type of advertising messages, unless said messages are printed on each sheet of said booklet, with a consequent obvious increasing of the booklet cost.

Accordingly, in the practice, the advertising messages are only printed on the side walls of the note-booklets.

Thus, as the single sheets are progressively used and detached, the advertising message comes to loose its efficacy, mostly if it comprises figures.

SUMMARY OF THE INVENTION

The present invention sets out to eliminate the aforesaid practical drawback by providing a note booklet having such a configuration, shape and arrangement as to be greatly effective as an advertising message supporting means.

According to one aspect of the present invention, there is provided a note booklet, characterized in that it comprises a plurality of squared superimposed sheets, joined to the back of a cover member, this latter being provided with a rear flat or flap therein one or two slots are formed and a front flat or flap including a folded sheet being joined along two edges whereof.

More specifically the note booklet according to the present invention is provided with a suitably shaped and ribbed cover member effective to present two surfaces provided for receiving thereon an advertising message.

Moreover said cover member is so designed as to provided, upon folding, a sheet holding pocket and being effective, in the meanwhile, as a pen holder.

BRIEF DESCRIPTION OF THE DRAWINGS

These and other characteristics, of functional and constructional nature of the note booklet, provided with a foldable cover member, according to the present invention, will become more apparent from the several figures of the accompanying drawings, where:

FIG. 1 is a rear perspective view of the note booklet according to the present invention, the cover member whereof being in a closed condition and the upper flat or flap being coupled to the lower one whereof by means of a tab member;

FIG. 2 is a front perspective view that illustrates that same note booklet, with the cover member in an open condition;

DESCRIPTION OF THE PREFERRED EMBODIMENT

Figures 3, 4, 5, 6:
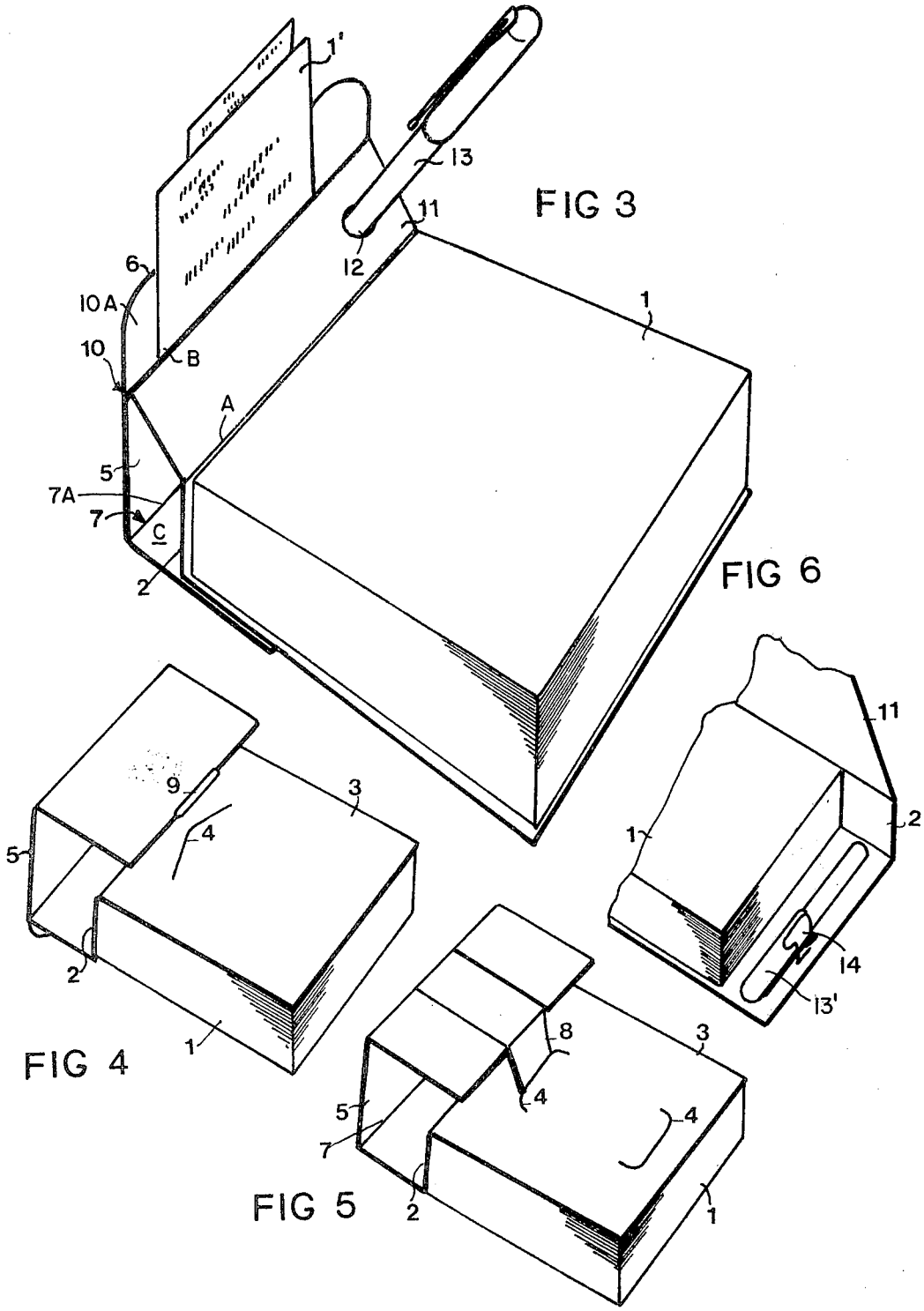
FIG. 3 is another front perspective view that illustrates the note booklet according to the invention with the cover member being folded and fixed to the lower flap.
FIG. 4 and FIG. 5 are rear perspective views that illustrate two possible manners for locking the folded cover member to the lower flap.
FIG. 6 is a partial front perspective view that illustrates a typical manner for forming, at the lower flap of the cover member, an holding tab effective to hold a pen, as provided with a conventional clip member.

Referring now to the number references of the figures of the accompanying drawings, the note booklet, according to the present invention, comprises a plurality of squared and superimposed sheets (1), being joined, for example by means of a resilient adhesive, to the back (2) of a cover member.

This latter is provided with a rear flat or flap (3), therein there are formed one or two slots, (4), and a front flat or flap formed by a folded sheet, of cardboard and the like, (5), joined along two edges whereof in such a way as to form a pocket effective to house note sheets (1').

Said front flap is preferably provided with a shaped free edge (6), and provided with an intermediate ribbed portion (7), effective to allow for said edge to be folded under the rear flap (3).

On said front flap, moreover, there is formed, for example by die cutting, a tab (8) or a simple slot (9), effective to permit the anchoring to the aforesaid rear flap (FIGS. 4 and 5).

This folding procedure permits to obtain a front plane (10) and a slanted plane (11) facing toward the user of the note booklet, and on these planes or surfaces it is possible to advantageously print advertising messages.

More specifically the slanted plane or surface (11) is provided with a side hole (12), effective to act as a holding seat for a pen (13).

Moreover, see FIG. 6, it is possible to cause an edge portion of the cover member to project from one side, with respect to the sheet stack (1), in such a way as to afford the possibility of forming, on the rear flap, and for exaple by means of a die cutting operation, a tab (14).

This tab may act as a holding member for a pen (13'), as provided with a conventional clip member, to be dispensed together with the note booklet.

The foregoing description thus exemplifies that the invention provides a note booklet, which comprises a plurality of super-imposed note sheets (1), secured in a pad to the back (2) of a cover member, which cover member has a first plane section (11) connected to the back (2) along a first fold line (A), a second plane section (5) connected to the first plane section (11) along a second fold line (B), a third plane section (C) connected to the second plane section (5) along a third fold line (7A), and a flap (10A) connected to the second plane section (5) to define therewith a pocket.

As better illustrated by FIG. 3, the cover member is foldable into a configuration whereby the first plane section (11) extends backwards from the pad of note sheets (1) to position the second plane section (5) and flap (10A) behind the note sheets (1), with the flap (10A) and pocket exposed behind the note sheets (1), and with the third plane section (C) extending in underlying relation to the bottom of the note sheets pad (1).

From the above description and the observation of the several figures of the accompanying drawings, are self-evident the great functionality and use facility characterizing the note booklet according to the present invention.

I claim:

1. A note booklet, which comprises a plurality of superimposed note sheets secured in a pad to the back of a cover member, said cover member having a first plane section connected to said back along a first fold line, a second plane section connected to said first plane section along a second fold line, a third plane section connected to said second plane section along a third fold line, and a flap connected to said second plane section to define therewith a pocket; said cover member being foldable into a configuration whereby said first plane section extends backwards from said pad of note sheets to position said second plane section and flap behind said note sheets with said flap and pocket exposed behind the note sheets, and with said third plane section extending in underlying relation to the bottom of said note sheets pad.

2. A note booklet, according to claim 1, including a tab connected to said third plane section and disposed for reception in a slot of a rear flap connected to the back of said cover member.

3. A note booklet according to claim 1, wherein said first plane section is slanted with respect to the back of said cover member, when same is folded into said configuration, and said first plane section has an aperture suitable to receive and hold a pen.

4. A note booklet according to claim 1, wherein said cover member projects laterally with respect to said pad of note sheets, and including a tab on said lateral projection of the cover member, which tab is operable to hold a pen.

* * * * *